US011380990B2

(12) United States Patent
Jia et al.

(10) Patent No.: US 11,380,990 B2
(45) Date of Patent: Jul. 5, 2022

(54) LIQUID CRYSTAL PHASE SHIFTER, MANUFACTURING METHOD OF THE SAME, AND LIQUID CRYSTAL ANTENNA

(71) Applicant: Shanghai Tianma Micro-Electronics Co., Ltd., Shanghai (CN)

(72) Inventors: Zhenyu Jia, Shanghai (CN); Kerui Xi, Shanghai (CN); Baiquan Lin, Shanghai (CN); Qinyi Duan, Sichuan (CN); Feng Qin, Shanghai (CN)

(73) Assignee: SHANGHAI TIANMA MICRO-ELECTRONICS CO., LTD., Shanghai (CN)

( * ) Notice: Subject to any disclaimer, the term of this patent is extended or adjusted under 35 U.S.C. 154(b) by 78 days.

(21) Appl. No.: 17/125,682

(22) Filed: Dec. 17, 2020

(65) Prior Publication Data

US 2022/0131264 A1 Apr. 28, 2022

(30) Foreign Application Priority Data

Oct. 22, 2020 (CN) ..... 202011136046.8

(51) Int. Cl.

| | |
|---|---|
| ***H01Q 3/36*** | (2006.01) |
| ***H01Q 1/38*** | (2006.01) |
| ***H01Q 1/48*** | (2006.01) |
| ***H01Q 7/00*** | (2006.01) |
| ***H01Q 21/06*** | (2006.01) |

(52) U.S. Cl.

CPC ..... *H01Q 3/36* (2013.01); *H01Q 1/38* (2013.01); *H01Q 1/48* (2013.01); *H01Q 7/00* (2013.01); *H01Q 21/061* (2013.01)

(58) Field of Classification Search

None

See application file for complete search history.

(56) References Cited

U.S. PATENT DOCUMENTS

2014/0266897 A1* 9/2014 Jakoby ..... H01Q 3/44 29/601
2020/0099115 A1* 3/2020 Sun ..... H01P 1/184

FOREIGN PATENT DOCUMENTS

CN 102136635 A 7/2011
CN 103022659 A 4/2013
CN 109728431 A 5/2019

* cited by examiner

*Primary Examiner* — Anh Q Tran

(74) *Attorney, Agent, or Firm* — Christensen O'Connor Johnson Kindness PLLC

(57) ABSTRACT

Provided are a liquid crystal phase shifter, a manufacturing method thereof, and a liquid crystal antenna. The liquid crystal phase shifter includes a first substrate, a second substrate, microstrips, a ground electrode, and liquid crystals located between the at least one microstrip and the ground electrode. The microstrip line is disposed on a side of the second substrate facing towards the first substrate and includes a first transmission line and a second transmission line that are each a coil and are nested with each other in a direction perpendicular to a plane of the second substrate. The coiling transmission directions of radio frequency signals transmitted on the first and second transmission lines are opposite. The ground electrode overlaps both the first transmission line and the second transmission line in the direction perpendicular to the plane of the second substrate.

20 Claims, 14 Drawing Sheets

LIQUID CRYSTAL PHASE SHIFTER, MANUFACTURING METHOD OF THE SAME, AND LIQUID CRYSTAL ANTENNA

CROSS-REFERENCE TO RELATED APPLICATIONS

The present application claims the benefit of priority to Chinese Patent Application No. 202011136046.8, filed on Oct. 22, 2020, the content of which is incorporated herein by reference in its entirety.

TECHNICAL FIELD

The present application relates to the technical field of liquid crystal antennas, in particular to a liquid crystal phase shifter, a manufacturing method thereof, and a liquid crystal antenna.

BACKGROUND

With the development and advance of communication systems, phase shifters are widely applied. In an example of a liquid crystal phase shifter, when a phase of a radio frequency signal is shifted, liquid crystals in a liquid crystal cell rotate under an electric field formed between a microstrip and a ground electrode, and thus a dielectric constant of the liquid crystals may change, thereby shifting the phase of the radio frequency signal transmitted on the liquid crystal phase shifter.

FIG. 1 is a structural schematic diagram of a microstrip in the related art. As shown in FIG. 1, in the related art, the microstrip 1' is designed in a coil shape to increase its length, so as to achieve a complete phase shift of the radio frequency signal. However, with such a configuration, the impedance of the microstrip 1' is often inductive, and thus in the impedance matching design, it is difficult to adjust other parameters of the phase shifter to match the inductive impedance of the microstrip 1', which in turn increases the return loss.

SUMMARY

In view of this, embodiments of the present disclosure provide a liquid crystal phase shifter, a manufacturing method of the liquid crystal phase shifter, and a liquid crystal antenna, which reduce the difficulties in impedance matching of the microstrip caused by the design of the microstrip.

In a first aspect, the present disclosure provides a liquid crystal phase shifter, including a first substrate and a second substrate that are arranged opposite to each other, at least one microstrip disposed on a side of the second substrate facing towards the first substrate and each comprising a first transmission line and a second transmission line, a ground electrode disposed on a side of the first substrate facing towards the second substrate, and liquid crystals located between the at least one microstrip and the ground electrode. The first substrate is located above a side of the second substrate facing a signal emission direction of the liquid crystal phase shifter. The first transmission line and the second transmission line are each a coil and are nested with each other in a direction perpendicular to a plane of the second substrate, and a coiling transmission direction of a radio frequency signal transmitted on the first transmission line is opposite to a coiling transmission direction of a radio frequency signal transmitted on the second transmission line. The ground electrode overlaps both the first transmission line and the second transmission line in the direction perpendicular to the plane of the second substrate.

In a second aspect, the present disclosure provides a manufacturing method of a liquid crystal phase shifter. The method includes: forming a ground electrode on a first substrate; forming at least one microstrip on a second substrate, each of the at least one microstrip comprising a first transmission line and a second transmission line, wherein the first transmission line and the second transmission line are each a coil and are nested with each other in a direction perpendicular to a plane of the second substrate, and a coiling transmission directions of a radio frequency signal transmitted on the first transmission line is opposite to a coiling transmission directions of a radio frequency signal transmitted on the second transmission line; and oppositely arranging the first substrate with the second substrate and filing liquid crystals between the first substrate and the second substrate, wherein, when the first substrate and the second substrate are oppositely arranged, the at least one microstrip is located on a side of the second substrate facing towards the first substrate, the ground electrode is located on a side of the first substrate facing towards the second substrate, and the ground electrode overlaps both the first transmission line and the second transmission line in the direction perpendicular to the plane of the second substrate.

In a third aspect, the present disclosure further provides a liquid crystal antenna, including: the liquid crystal phase shifter according to the first aspect; a feed network configured to provide radio frequency signals; and a radiator arranged on a side of the first substrate facing away from the second substrate, and configured to radiate a phase-shifted radio frequency signal.

BRIEF DESCRIPTION OF DRAWINGS

In order to explain technical solutions of embodiments of the present disclosure, the drawings for describing the embodiments are briefly introduced as below. It should be noted that the drawings merely illustrate some embodiments of the present disclosure. Those skilled in the art can derive other drawings from these drawings.

DESCRIPTION OF EMBODIMENTS

It should be understood that the embodiments described below are merely some of, rather than all of the embodiments of the present disclosure. Based on the embodiments described in the present disclosure, all other embodiments obtained by those skilled in the art shall fall within the protection scope of the present disclosure.

The terms used in the embodiments of the present disclosure are merely for the purpose of describing specific embodiments, but not intended to limit the present disclosure. The singular forms of "a", "an" and "the" used in the embodiments of the present disclosure and the appended claims are also intended to indicate plural forms, unless clearly indicating others.

It should be understood that the term "and/or" used herein merely indicates a relationship describing associated objects, indicating three possible relationships. For example, the expression "A and/or B" indicates: A exists alone, both A and B exist, or B exists alone. In addition, the character "/" in this description generally means that the associated objects are in an "or" relationship.

It should be understood that, although the terms "first" and "second" are used to describe substrates, transmission lines, input terminals, output terminals and openings in the embodiments of the present disclosure, the substrates, transmission lines, input terminals, output terminals and openings should not be limited to these terms. These terms are only used to distinguish the substrates, transmission lines, input terminals, output terminals and openings from each other. For example, without departing from the scope of the embodiments of the present disclosure, the first substrate may also be referred to as the second substrate, and similarly, the second substrate may also be referred to as the first substrate.

Figure 1:
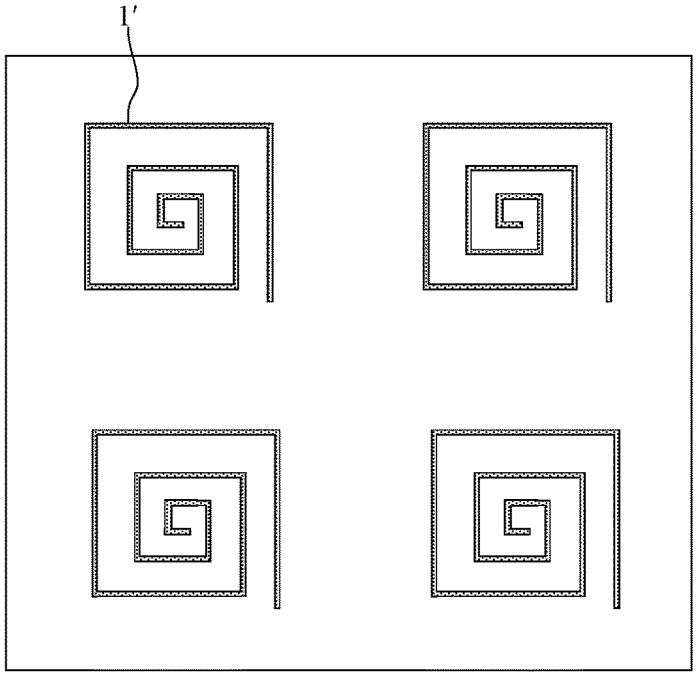
FIG. 1 (PRIOR ART)
FIG. 1 is a structural schematic diagram of a microstrip known in the related art.
Figure 2:
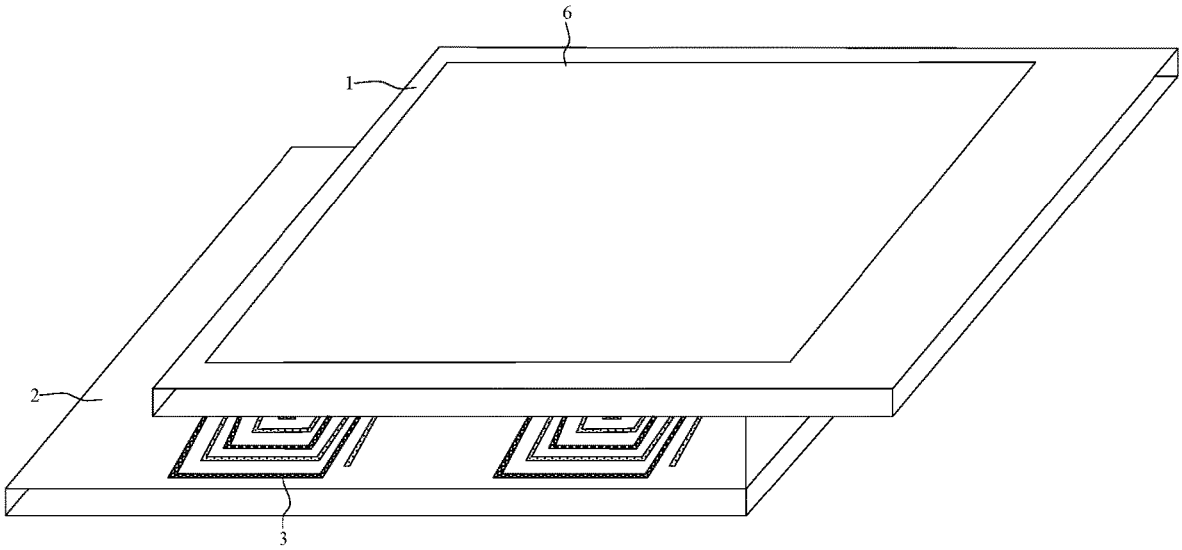
FIG. 2 is a structural schematic diagram of a liquid crystal phase shifter provided by an embodiment of the present disclosure.
Figure 3:
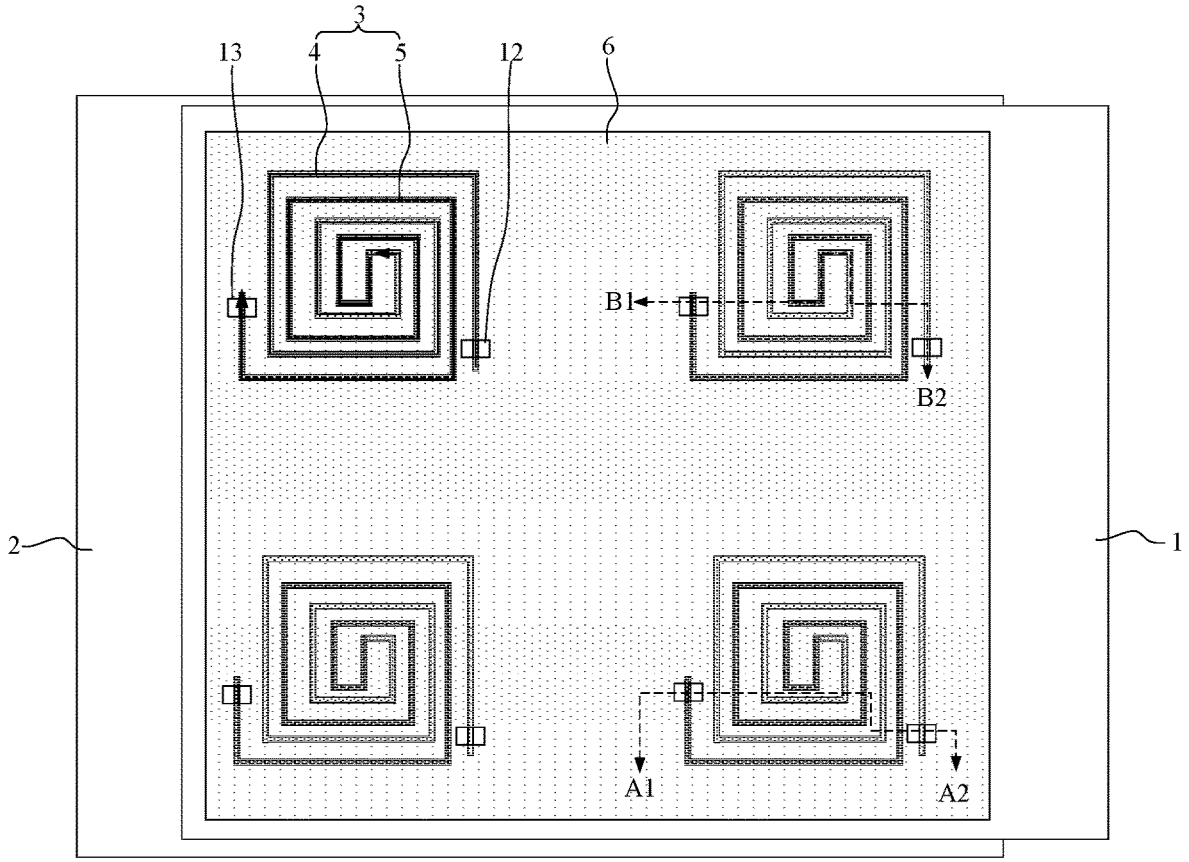
FIG. 3 is a structural schematic diagram of a microstrip provided by an embodiment of the present disclosure.
Figure 4:
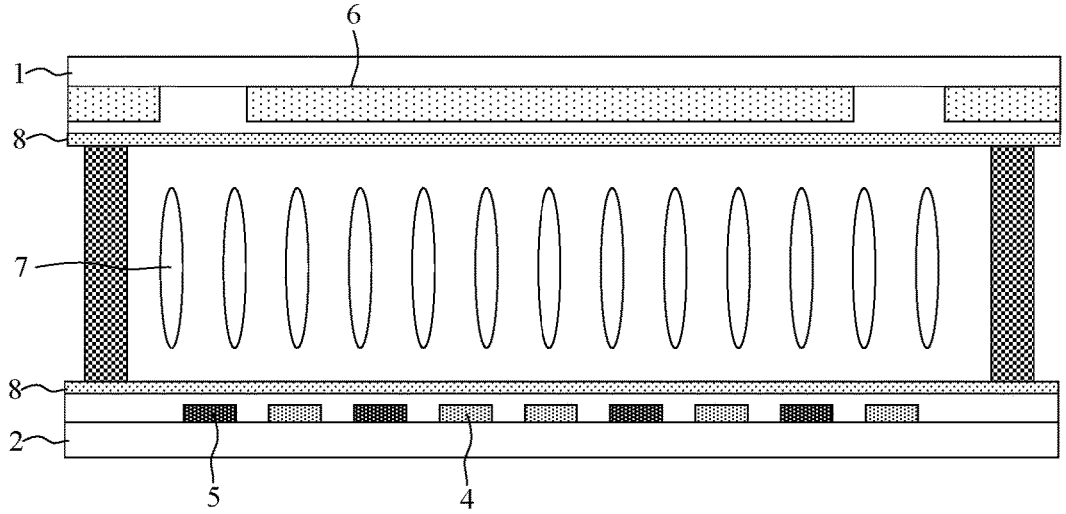
FIG. 4 is a cross-sectional view taken along a direction A1-A2 in FIG. 3.

An embodiment of the present disclosure provides a liquid crystal phase shifter. FIG. 2 is a structural schematic diagram of a liquid crystal phase shifter provided by an embodiment of the present disclosure, FIG. 3 is a structural schematic diagram of a microstrip provided by an embodiment of the present disclosure, and FIG. 4 is a cross-sectional view taken along a direction A1-A2 in FIG. 3. As shown in FIGS. 2-4, the liquid crystal phase shifter includes a first substrate 1, a second substrate 2 opposite to the first substrate 1, microstrips 3, a ground electrode 6, and liquid crystals 7. The first substrate 1 is located above a side of the second substrate 2 facing towards a signal emission direction of the liquid crystal phase shifter. The first substrate 1 and the second substrate 2 can be glass substrates, polyimide (PI) substrates, liquid crystal polymer (LCP) material or high-frequency substrates. The microstrips 3 are located on a side of the second substrate 2 facing towards the first substrate 1. Each microstrip 3 includes a first transmission line 4 and a second transmission line 5, and both the first transmission line 4 and the second transmission line 5 have a coil structure. In a direction perpendicular to the plane of the second substrate 2, the first transmission line 4 and the second transmission line 5 are nested with each other, and a radio frequency signal in the first transmission line 4 is transmitted along a direction opposite to its coiling direction, and a radio frequency signal in the second transmission line 5 is transmitted along a direction opposite to its coiling direction. The ground electrode 6 is located on a side of the first substrate 1 facing towards the second substrate 2. In the direction perpendicular to the plane of the second substrate 2, the ground electrode 6 overlaps both the first transmission line 4 and the second transmission line 5. The liquid crystals 7 are located between the microstrips 3 and the ground electrode 6.

Further referring to FIG. 4, in order to drive the liquid crystals 7 to rotate normally, the side of the first substrate 1 facing towards the second substrate 2 and the side of the second substrate 2 facing towards the first substrate 1 are each provided with an alignment film 8.

When the above liquid crystal phase shifter is driven to shift the phase of the radio frequency signal, a ground signal terminal provides a ground signal to the ground electrode 6, a flexible circuit board provides a drive signal to the first transmission line 4 and/or the second transmission line 5, and the liquid crystals 7 rotate under an electric field formed between the ground electrode 6 and the first transmission line 4 and between the ground electrode 6 and the second transmission line 5, so as to change a dielectric constant of the liquid crystals 7. In this way, the phase of the radio frequency signal transmitted on the first transmission line 4 and the second transmission line 5 is shifted.

In the liquid crystal phase shifter provided by the embodiments of the present disclosure, the first transmission line 4 and the second transmission line 5 that are included in the microstrip 3 each has a coil structure. Thus, each of the first transmission line 4 and the second transmission line 5 is equivalent to a coil structure. When radio frequency signals are transmitted on the first transmission line 4 and the second transmission line 5, magnetic fields will be generated around the first transmission line 4 and the second transmission line 5. Further, since the radio frequency signal transmitted on the first transmission line 4 and the radio frequency signal transmitted on the second transmission line 5 are in opposite coiling directions, high-frequency currents corresponding to the radio frequency signals are also transmitted in opposite directions. According to the right-hand screw rule, the magnetic field formed by the first transmission line 4 and the magnetic field formed by the second transmission line 5 have opposite directions. Therefore, the magnetic field formed by the first transmission line 4 offsets the magnetic field formed by the second transmission line 5, thereby effectively weakening the magnetic field of the entire microstrip 3 and reducing the inductive component of the characteristic impedance of the microstrip 3.

In addition, since the first transmission line 4 and the second transmission line 5 are nested and the magnetic fields formed by the first transmission line 4 and the second transmission line 5 at the same position are similar in their intensities, the two magnetic fields mutually counteract to a greater extent. The nested first transmission line 4 and second transmission line 5 occupy a smaller space, which is also conducive to reducing a size of the liquid crystal phase shifter.

In this regard, for the liquid crystal phase shifter provided by the embodiment of the present disclosure, by providing the microstrip 3 in a nested double-coil structure and transmitting the radio frequency signals in the two coils in opposite coiling directions, the inductive impedance of the microstrip 3 is significantly reduced, such that the characteristic impedance of the microstrip 3 tends to be the pure resistance, thereby reducing difficulties in impedance matching of the microstrip 3, reducing return loss, and optimizing the phase shifting effect of the liquid crystal phase shifter on the radio frequency signals.

In addition, in the embodiments of the present disclosure, the first transmission line 4 and the second transmission line 5 that are included in the microstrip 3 each has a coil shape. Compared with the related art, by utilizing the shape of the microstrip 3 as in the embodiments of the present disclosure, a wiring length of the microstrip 3 is increased while reducing the difficulties in impedance matching. In this way, the phase shift of the radio frequency signals transmitted on the microstrip 3 is more effective, further optimizing the phase shifting performance of the liquid crystal phase shifter.

Figure 5:
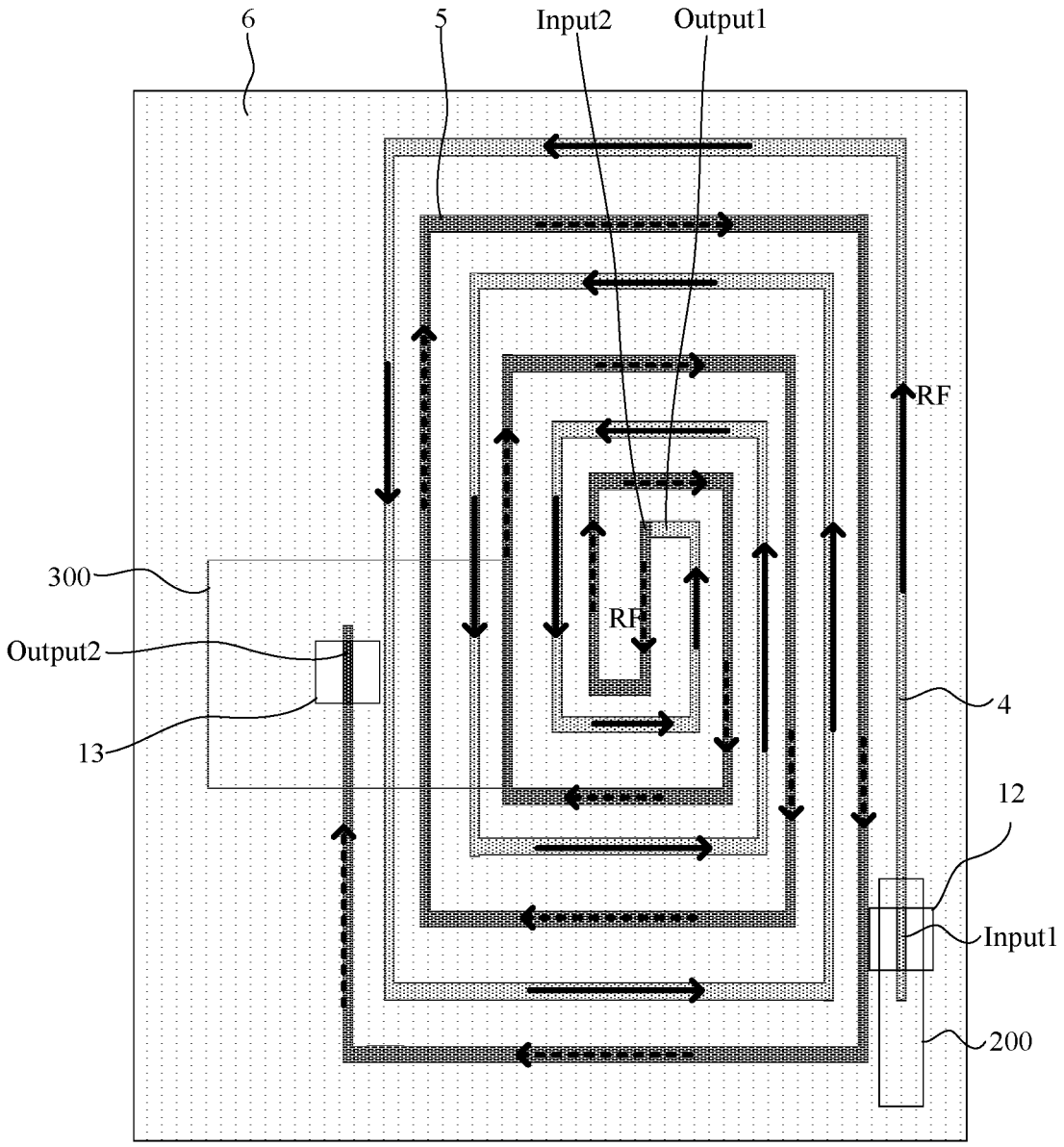
FIG. 5 is a structural schematic diagram of a microstrip provided by another embodiment of the present disclosure.

FIG. 5 is a structural schematic diagram of a microstrip provided by an embodiment of the present disclosure. In the embodiment shown in FIG. 5, the first transmission line 4 includes a first input terminal Input1 and a first output terminal Output1. The first input terminal Input1 is an outermost end of the coil of the first transmission line 4, and the first input terminal Input1 is configured to receive the radio frequency signal. The first output terminal Output1 is an innermost end of the coil of the first transmission line 4. The second transmission line 5 includes a second input terminal Input2 and a second output terminal Output2. The second input terminal Input2 is an innermost end of the coil of the second transmission line 5, and the second output terminal Output2 is an end of the outermost circle of the second transmission line 5. The second output terminal Output2 is configured to the radiate phase-shifted radio frequency signals.

By setting the first input terminal Input1 for receiving the radio frequency signals as the outermost end of the coil of the first transmission line 4, and setting the second output terminal Output2 for radiating the phase-shifted radio frequency signals as the outermost end of the coil of the second transmission line 5, when the radio frequency signals are transmitted on the first transmission line 4 and the second transmission line 5, the radio frequency signal transmitted to the first transmission line 4 is transmitted from the outermost loop of the coil of the first transmission line 4 to the innermost loop of the coil of the first transmission line 4, i.e., along a transmission direction of the radio frequency signal RF in the first transmission line 4 shown by the solid arrow in FIG. 5. The radio frequency signal in the second transmission line 5 is transmitted from the innermost loop of the coil of the second transmission line 5 to the outermost loop of the coil of the second transmission line 5, i.e., along a transmission direction of the radio frequency signal RF in the second transmission line 5 shown by the dashed arrow in FIG. 5. In this way, the transmission direction of the radio frequency signal RF in the first transmission line 4 is opposite to the transmission direction of the radio frequency signal RF in the second transmission line 5, and the magnetic field formed by the first transmission line 4 and the magnetic field formed by the second transmission line 5 counteract each other.

Figure 16:
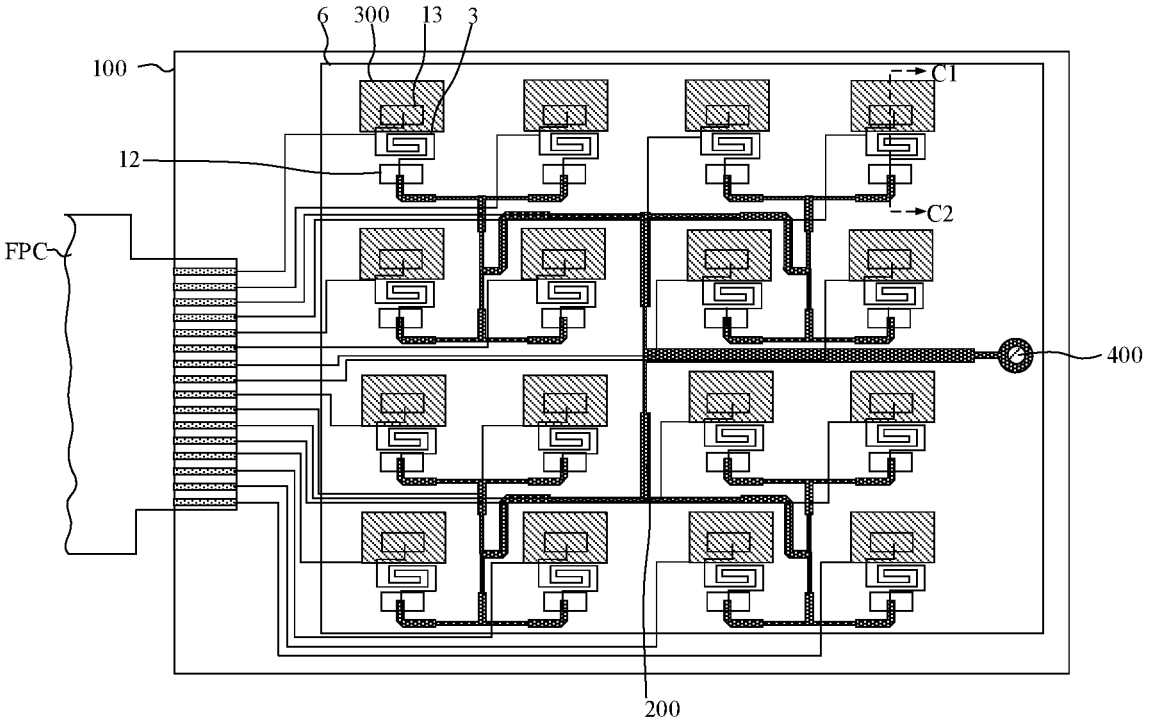
FIG. 16 is a structural schematic diagram of a liquid crystal antenna provided by an embodiment of the present disclosure.
Figure 17:
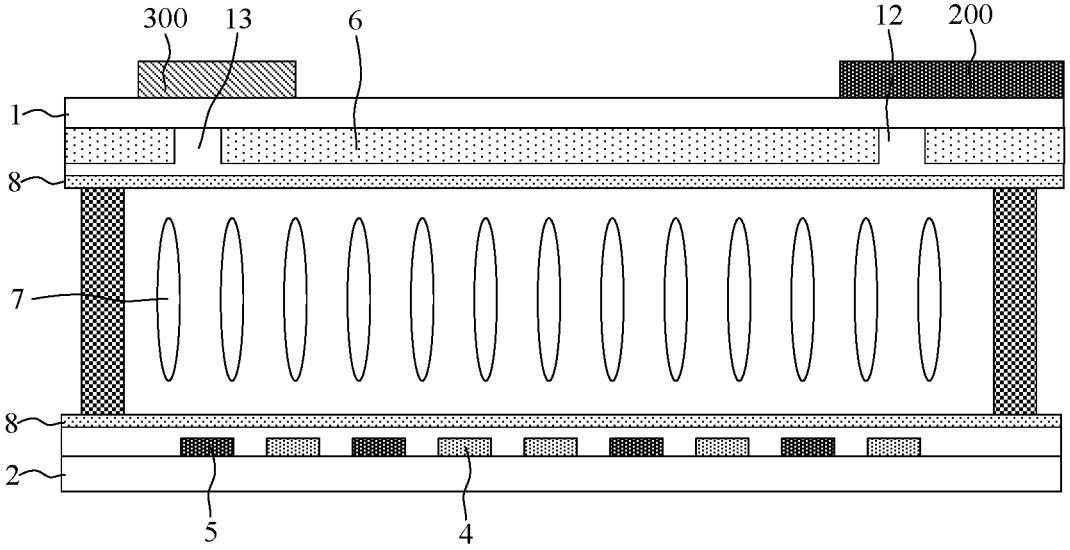
FIG. 17 is a cross-sectional view taken along a direction C1-C2 in FIG. 16.

In addition, in conjunction with FIGS. 5, 16 and 17, a first opening 12 and a second opening 13 are provided on the ground electrode 6 and configured to couple the radio frequency signals. The liquid crystal antenna further includes a feed network 200 and a radiator 300. In the direction perpendicular to the plane of the second substrate 2, the first opening 12 overlaps both the first input terminal Input1 of the first transmission line 4 and the feed network 200, and the second opening 13 overlaps both the second output terminal Output2 of the second transmission line 5 and the radiator 300. When the liquid crystal phase shifter is used to shift the phase of the radio frequency signal, the radio frequency signal transmitted on the feed network 200 is coupled to the first input terminal Input1 of the first transmission line 4 through the first opening 12 of the ground electrode 6, and is then transmitted through the first transmission line 4 to the second input terminal Input2 of the second transmission line 5, and the phase-shifted radio frequency signal is coupled to the radiator 300 through the second output terminal Output2 through the second opening 13, and is radiated out through the radiator 300.

Based on the above principle, in order to realize the coupling of the radio frequency signals, it is necessary that the feed network 200 overlaps the first input terminal Input1 of the first transmission line, and the radiator 300 overlaps the second output terminal Output2 of the second transmission line 5. By setting the first input terminal Input1 as the outermost end of the coil of the first transmission line 4, it is ensured that the feed network 200 overlaps the first input terminal Input1 to allow the radio frequency signal to be coupled to the first input terminal Input1. Furthermore, the feed network 200 is less likely to overlap other parts of the first transmission line 4 and the second transmission line 5, which reduces the risk of coupling of the radio frequency signals to the other parts of the first transmission line 4 and the second transmission line 5 through the first opening 12. Similarly, by setting the second output terminal Output2 as the outermost end of the coil of the second transmission line 5, it is ensured that the radiator 300 overlaps the second output terminal Output2 to allow the phase-shifted radio frequency signal to be coupled to the radiator 300 by the second output terminal Output2. Furthermore, the radiator 300 less overlaps other parts of the first transmission line 4 and the second transmission line 5, thereby preventing the radio frequency signals that are still transmitted on the first transmission line 4 and the second transmission line 5 and not been fully phase-shifted from being coupled to the radiator 300 through the second opening 13. In this way, the accuracy of a radiation angle of a wave beam radiated by the liquid crystal antenna is enhanced.

Figure 6:
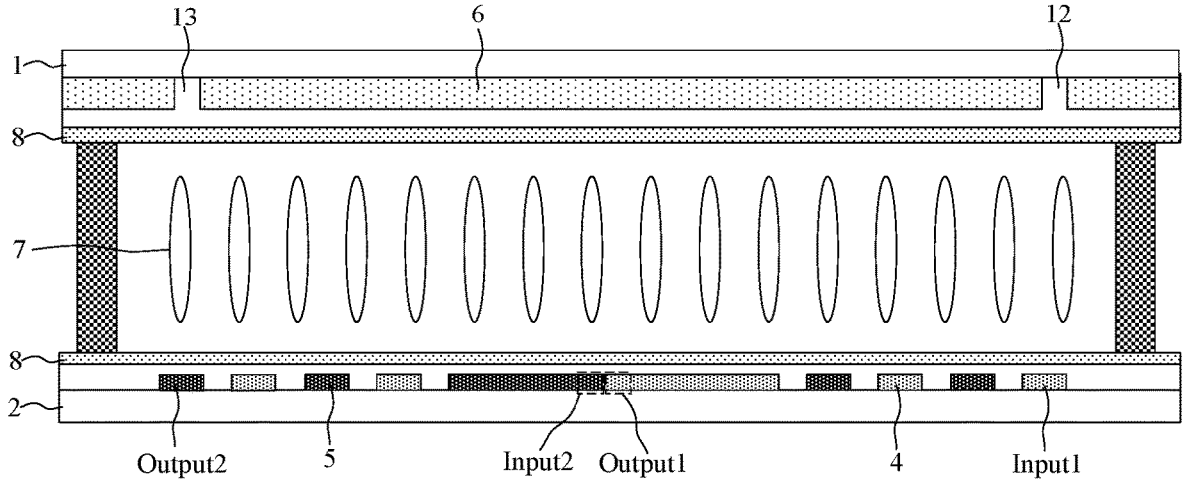
FIG. 6 is a cross-sectional view taken along a direction B1-B2 in FIG. 3.

FIG. 6 is a cross-sectional view taken along the direction B1-B2 in FIG. 3. As shown in FIG. 6 and FIG. 5, the first transmission line 4 and the second transmission line 5 are arranged in the same layer, and the first output terminal Output1 is electrically connected to the second input terminal Input2. In this case, the radio frequency signal transmitted on the first transmission line 4 is directly transmitted to the second input terminal Input2 via the first output terminal Output1. Such transmission has higher transmission reliability and less loss of the radio frequency signals. In addition, since the first transmission line 4 and the second transmission line 5 are arranged in the same layer, the microstrip 3 occupies only one layer, which is more conducive to the thin and light-weight design of the liquid crystal phase shifter.

In addition, it should be understood that, in such an arrangement, since the first transmission line 4 and the second transmission line 5 are electrically connected to each other, the flexible circuit board FPC is connected either to the first transmission line 4 or to the second transmission line 5 through one connecting lead to transmit a driving signal to the first transmission line 4 and the second transmission line 5.

Figure 7:
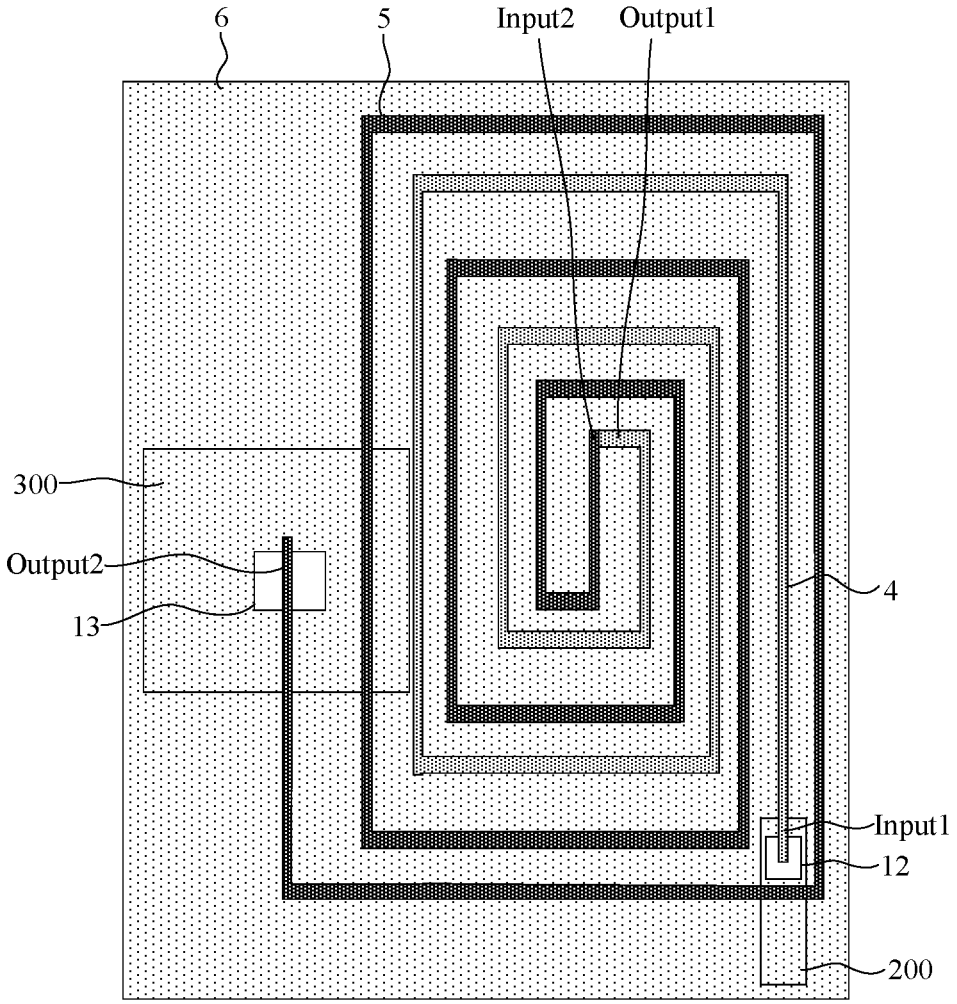
FIG. 7 is a structural schematic diagram of a first transmission line and a second transmission line that have different numbers of coil turns according to an embodiment of the present disclosure.

Further referring to FIG. 5, a number of coil turns of the first transmission line 4 is the same as that of the second transmission line 5. When the first transmission line 4 and the second transmission line 5 are arranged in the same layer, and the number of coil turns of the first transmission line 4 is different from the number of coil turns of the second transmission line 5, the feed network 200 overlaps the first input terminal Input1, so as to couple the radio frequency signal to the first input terminal Input1. For example, FIG. 7 illustrate the first transmission line and the second transmission line that have different numbers of coil turns. When the first transmission line 4 has a smaller number of coil turns than the second transmission line 5 and the feed network 200 overlaps the first input terminal Input1 to couple the radio frequency signal to the first input terminal Input1, if the feed network 200 is required to overlap the first input terminal Input1 and not overlap other parts of the first transmission line 4 and the second transmission line 5, the first input terminal Input1 has to extend across the outer loop of the coil of the second transmission line 5 to the outside of the second transmission line 5. This is difficult to be implemented in process, as the first transmission line 4 and the second transmission line 5 are arranged in the same layer. If the first input terminal Input1 does not extend to the outside of the second transmission line 5, the feed network 200 will inevitably overlap the second transmission line 5 (see FIG. 7), increasing the risk that the radio frequency signal transmitted on the electrical network 200 is directly coupled to the second transmission line 5 through the first opening 12, thus affecting the input of the radio frequency signal.

Figure 8:
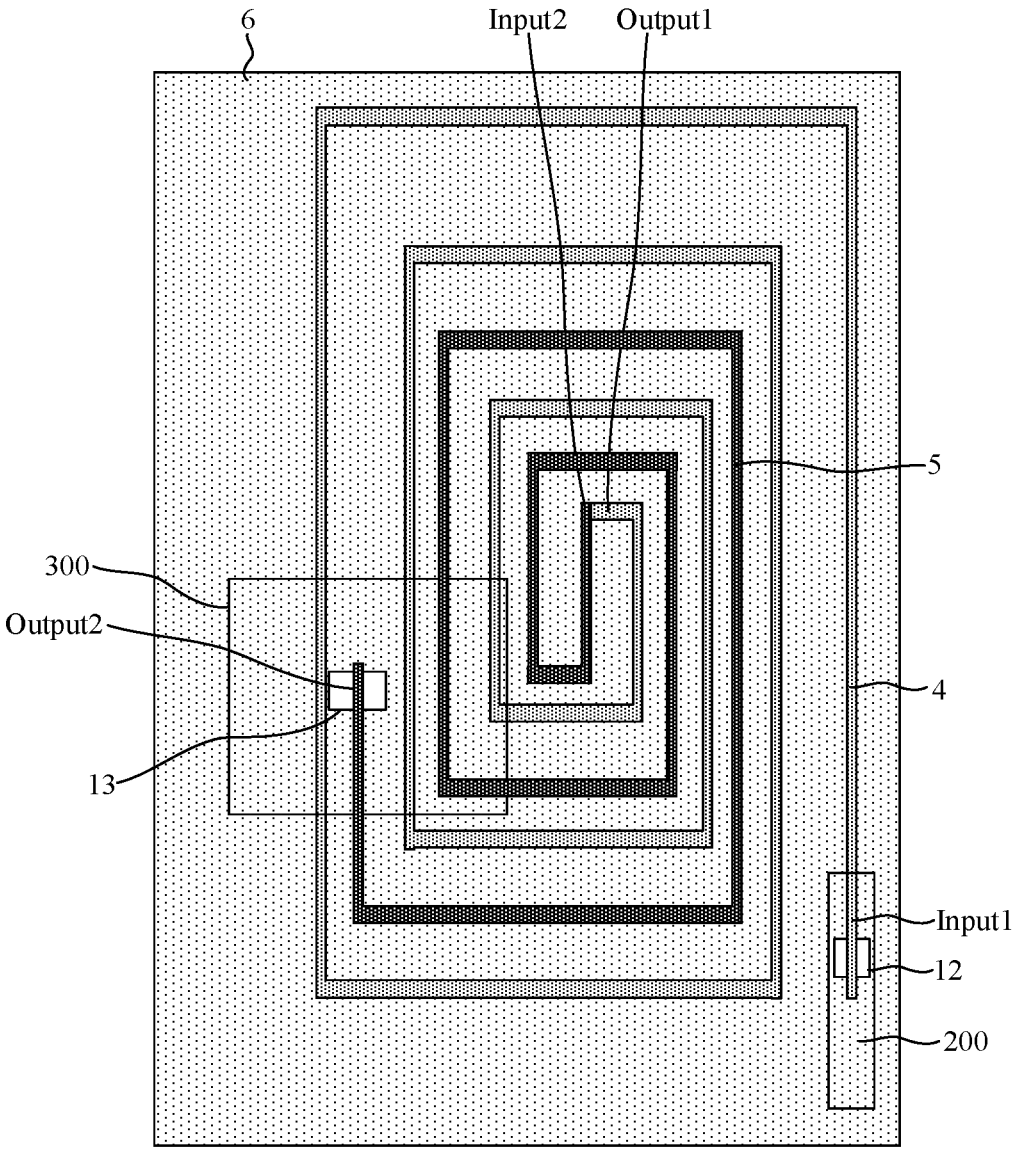
FIG. 8 is a structural schematic diagram of a first transmission line and a second transmission line that have different numbers of coil turns according to another embodiment of the present disclosure.

FIG. 8 illustrate another case where the first transmission line and the second transmission line have different numbers of coil turns. As shown in FIG. 8, when the number of coil turns of the second transmission line 5 is smaller than that of the first transmission line 4, the second output terminal Output2 is surrounded by one loop of the coil the first transmission line 4. Thus, the radio frequency signal that is still transmitted on the first transmission line 4 and has not been fully phase-shifted may be coupled to the radiator 300 through the second opening 13, and then radiated by the radiator 300, thereby adversely affecting the radiation angle of the beam radiated by the liquid crystal antenna. Therefore, in the embodiments of the present disclosure, the number of coil turns of the first transmission line 4 is set to be equal to the number of coil turns of the second transmission line 5, so as to reduce the processing difficulty, and enhance the reliability of coupling of the radio frequency signal.

Figure 9:
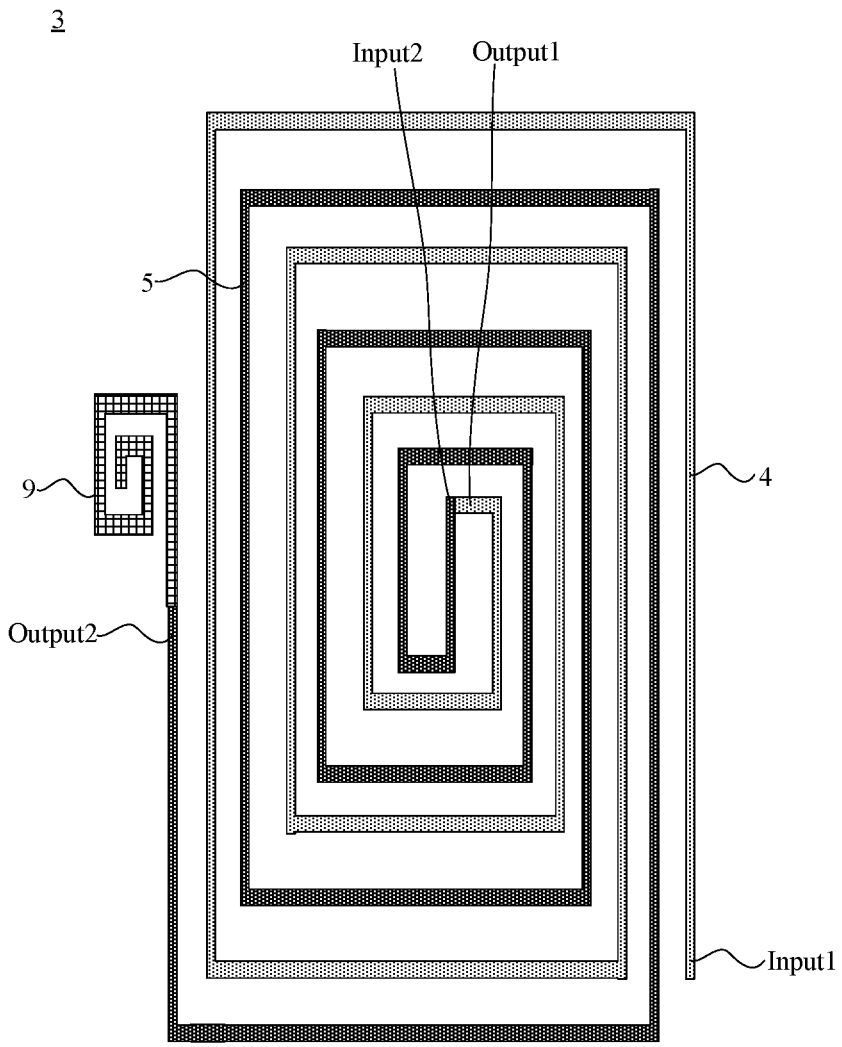
FIG. 9 is a structural schematic diagram of a microstrip provided by yet another embodiment of the present disclosure.

FIG. 9 is a structural schematic diagram of a microstrip provided by yet another embodiment of the present disclosure. As shown in FIG. 9, the second output terminal Output2 is further electrically connected to a third transmission line 9, and the third transmission line 9 is in a coil shape.

It should be noted that, in a preferred state, for better impedance matching, the characteristic impedance of the microstrip 3 is a pure resistive impedance consisting of an inherent inductance and an inherent capacitance. However, in the related art, the design of a single-coil microstrip increases the inductance of the microstrip, and thus the actual inductance of the microstrip 3 exceeds the ideal inherent inductance, resulting in that the characteristic impedance of the microstrip becomes inductive. In the embodiments of the present disclosure, since the first transmission line 4 and the second transmission line 5 have the same number of coil turns, the magnetic field formed by the first transmission line 4 and the magnetic field formed by the second transmission line 5 are approximately the same, and thus the magnetic field formed by the first transmission line 4 and the magnetic field formed by the second transmission line 5 almost completely counter each other, such that the inductance of the microstrip 3 is approximately zero. For this purpose, by further electrically connecting the third transmission line 9 in coil shape to the second output terminal Output2 of the second transmission line 5, the third transmission line 9 can be used to form an inherent inductance, which then consists the pure characteristic impedance with the inherent capacitance of the microstrip 3, thereby reducing the difficulty of impedance matching to a greater extent and optimizing the design of the liquid crystal phase shifter.

Figure 10:
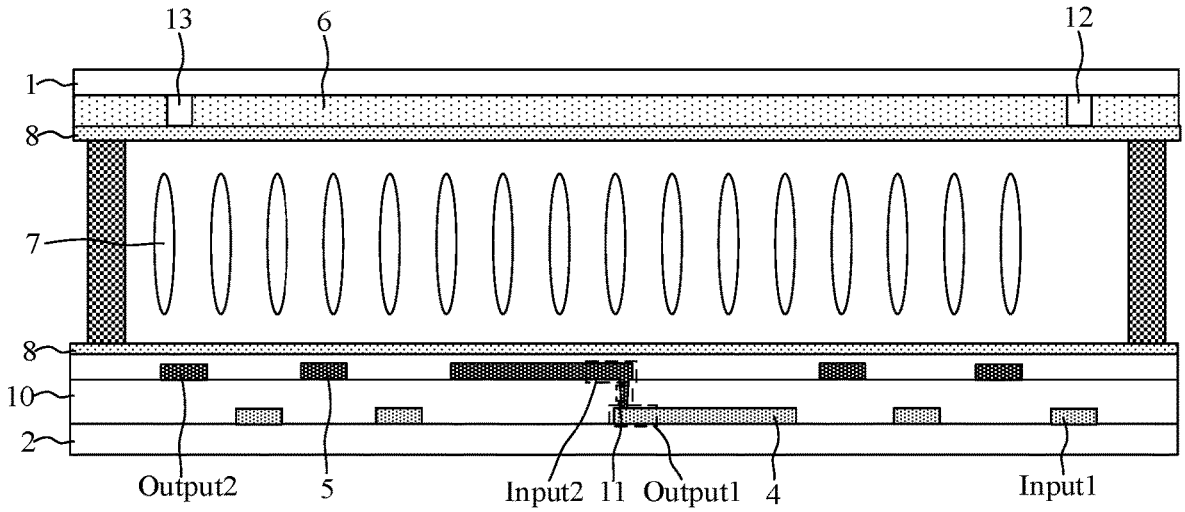
FIG. 10 is another cross-sectional view along the direction B1-B2 in FIG. 3.

FIG. 10 is another cross-sectional view taken along the direction B1-B2 in FIG. 3. In the embodiment shown in FIG. 10, the first transmission line 4 and the second transmission line 5 are arranged in different layers, and an insulating layer 10 having a via hole 11 is provided between the first transmission line 4 and the second transmission line 5. The second input terminal Input2 is electrically connected to the first output terminal Output1 through the via hole 11. In this case, the first transmission line 4 is directly electrically connected to the second transmission line 5, the radio frequency signal transmitted on the transmission line 4 is directly transmitted to the second transmission line 5 through the via hole 11, with less loss of the transmitted radio frequency signal.

In addition, with such an arrangement, since the first transmission line 4 and the second transmission line 5 are electrically connected to each other, the driving signal can be transmitted to the first transmission line 4 and the second transmission line 5 when the flexible circuit board FPC is connected to the first transmission line 4 or the second transmission line through only one connecting lead 5.

Figure 11:
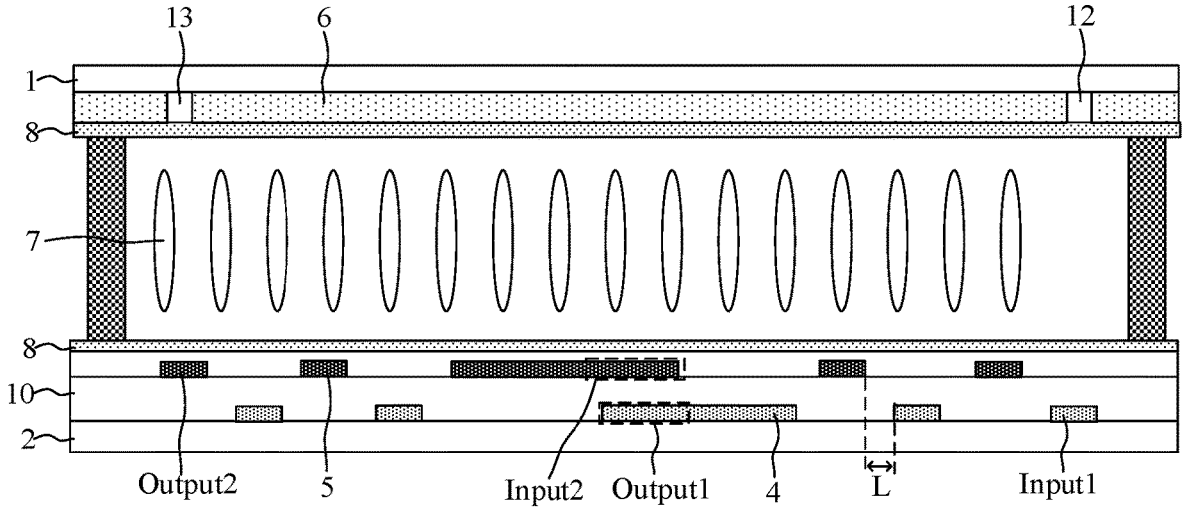
FIG. 11 is yet another cross-sectional view along the direction B1-B2 in FIG. 3.

FIG. 11 is another cross-sectional view taken along the direction B1-B2 in FIG. 3. As shown in FIG. 11, the first transmission line 4 and the second transmission line 5 are arranged in different layers, an insulating layer 10 is provided between the first transmission line 4 and the second transmission line 5, and the first output terminal Output1 overlaps the second input terminal Input2 in the direction perpendicular to the plane of the second substrate 2. In this case, it is unnecessary to build an electrical connection between the first transmission line 4 and the second transmission line 5, as the radio frequency signal is transmitted from the first transmission line 4 to the second transmission line 5 in such a manner that the radio frequency signal transmitted on the first transmission line 4 is coupled to the second input terminal Input2 through the first output terminal Output1. In this way, it is unnecessary to etch the via hole 11 in the insulating layer 10, which simplifies the processing and reduces the process cost.

Further referring to FIG. 11, a distance L between an orthographic projection of the first transmission line 4 on the plane of the second substrate 2 and an orthographic projection of the second transmission line 5 on the plane of the second substrate 2 satisfies $L>50$ μm. In the manufacturing process of the first transmission line 4 and the second transmission line 5, due to factors such as alignment errors, the positions of the first transmission line 4 and/or the second transmission line 5 may change. If the horizontal spacing between the first transmission line 4 and the second transmission line 5 is small, the first transmission line 4 and the second transmission line 5 may overlap in a region outside the first output terminal Output1 and the second input terminal Input2, resulting in signal coupling in this region. For this reason, by setting L to be greater than 50 μm, a sufficient horizontal spacing can be provided between the first transmission line 4 and the second transmission line 5, such that the overlapping of the first transmission line 4 and the second transmission line 5 is less likely occurs in other regions, improving the reliability of signal coupling.

In addition, in such an arrangement, the first transmission line 4 is not electrically connected to the second transmission line 5, the flexible circuit board FPC is connected to the first transmission line 4 and the second transmission line 5 through two connecting leads, respectively, so as to provide driving signals respectively to the first transmission line 4 and the second transmission line 5.

In an embodiment, referring to FIG. 9, the number of coil turns of the first transmission line 4 is equal to the number of coil turns of the second transmission line 5, the second output terminal Output2 is further electrically connected to a third transmission line 9, and the third transmission line 9 is in a coil shape. The third transmission line 9 forms an inherent inductance which in turn forms a pure characteristic impedance together with the inherent capacitance of the microstrip 3, thereby improving impedance matching and optimizing the design of the liquid crystal phase shifter.

Figure 12:
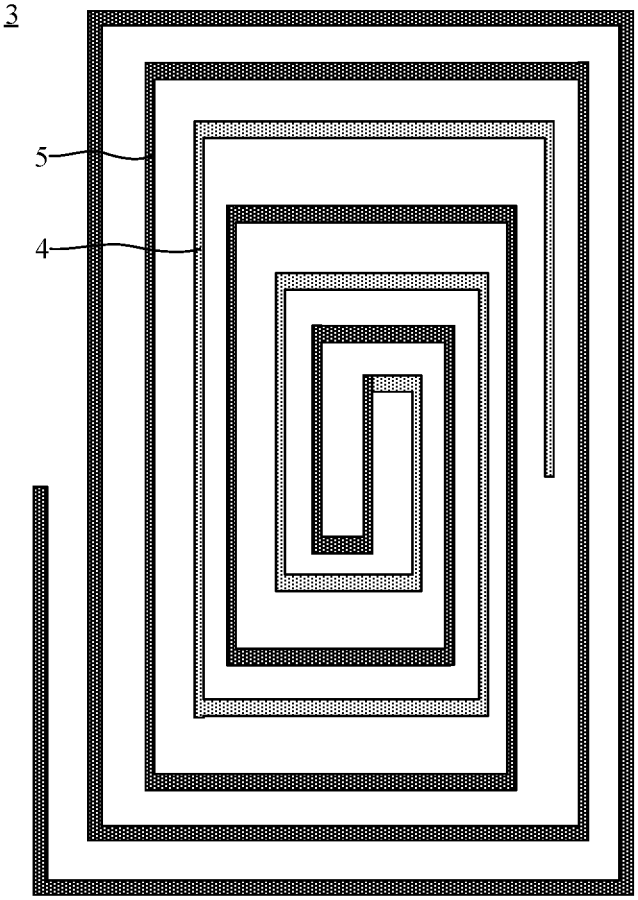
FIG. 12 is a structural schematic diagram of a microstrip provided by yet another embodiment of the present disclosure.

FIG. 12 is a structural schematic diagram of a microstrip provided by yet another embodiment of the present disclosure. As shown in FIG. 12, the number of coil turns of the first transmission line 4 is unequal to the number of coil turns of the second transmission line 5. In this case, the magnetic field formed by the first transmission line 4 and the magnetic field formed by the second transmission line 5 have different intensities, and they mutually counteract, but a residual magnetic field of certain intensity still remains. An inductance formed by the residual magnetic field can act as an inherent inductance, the value of which can be adjusted by adjusting the number of turns of the first transmission line 4 and the second transmission line 5, therefore sufficiently utilizing the inherent capacitance of the inductance and improving the impedance matching.

Further referring to FIGS. 5, 6, 10, and 11, the ground electrode 6 has a first opening 12 and a second opening 13 for coupling radio frequency signals. In the direction perpendicular to the plane of the second substrate 2, the first opening 12 overlaps the first input terminal Input1, and the second opening 13 overlaps the second output terminal Output2. In conjunction with FIGS. 16 and 17, the radio frequency signal provided by the feed network 200 is coupled to the first input terminal Input1 through the first opening 12, and is transmitted to the first transmission line 4 and the second transmission line 5, and the phase-shifted radio frequency signal is coupled to the radiator 300 through the second opening 13, and is then radiated out by the radiator 300.

In an embodiment, the first transmission line 4 and the second transmission line 5 can be made of the same material. When the first transmission line 4 and the second transmission line 5 are made of different metal materials, the characteristics of materials may affect the intensities of the magnetic fields formed by the first transmission line 4 and the second transmission line 5, and even if the first transmission line 4 and the second transmission line 5 have the same number of coil turns, the intensity of the magnetic field generated by the first transmission line 4 may be still different from the intensity of the magnetic field generated by the second transmission line 5, increasing the difficulty in controlling a degree of counteracting of the two magnetic fields. When the first transmission line 4 and the second transmission line 5 is made of the same material, the material-related difference between the intensities of the magnetic fields formed by the first transmission line 4 and the second transmission line 5 is negligible, so as to more accurately control the degree of counteracting of the two magnetic fields.

Figure 13:
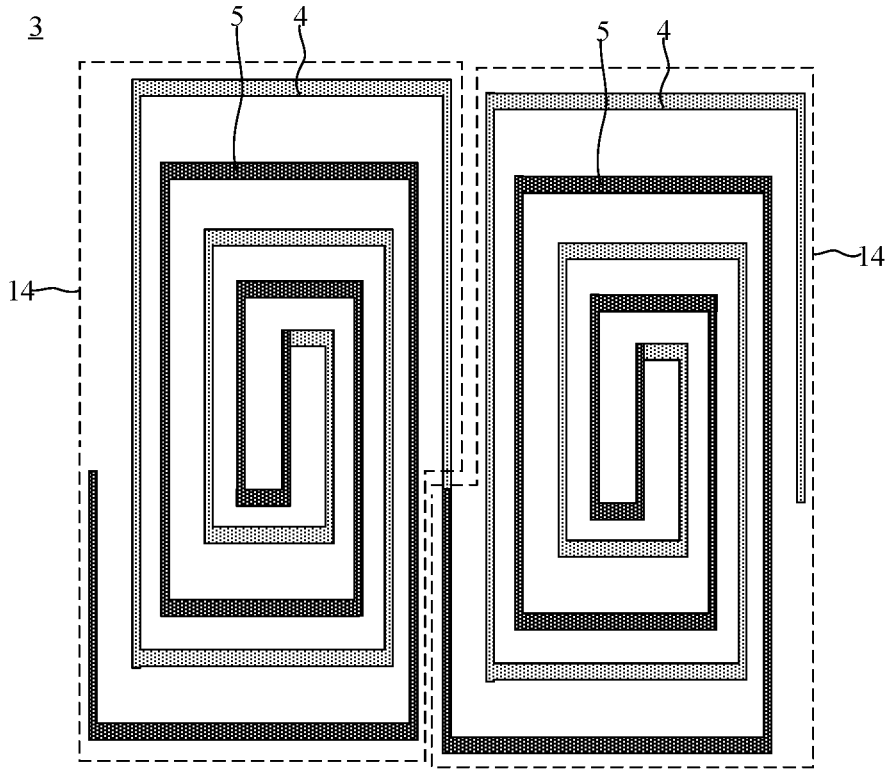
FIG. 13 is a structural schematic diagram of a microstrip provided by yet another embodiment of the present disclosure.

FIG. 13 is a structural schematic diagram of a microstrip provided by an embodiment of the present disclosure. As shown in FIG. 13, a transmission line unit 14 is formed by the nested first transmission line 4 and second transmission line 5. The microstrip 3 includes m transmission line units 14, where $m \geq 2$. The second transmission line 5 in an i-th transmission line unit 14 is electrically connected to the first transmission line 4 in a (i−1)-th transmission line unit 14, where $2 \leq i \leq m$. With such a configuration, the wiring length of the microstrip 3 can be significantly increased, thereby achieving larger phase shift of the radio frequency signal transmitted on the microstrip 3.

Figure 14:
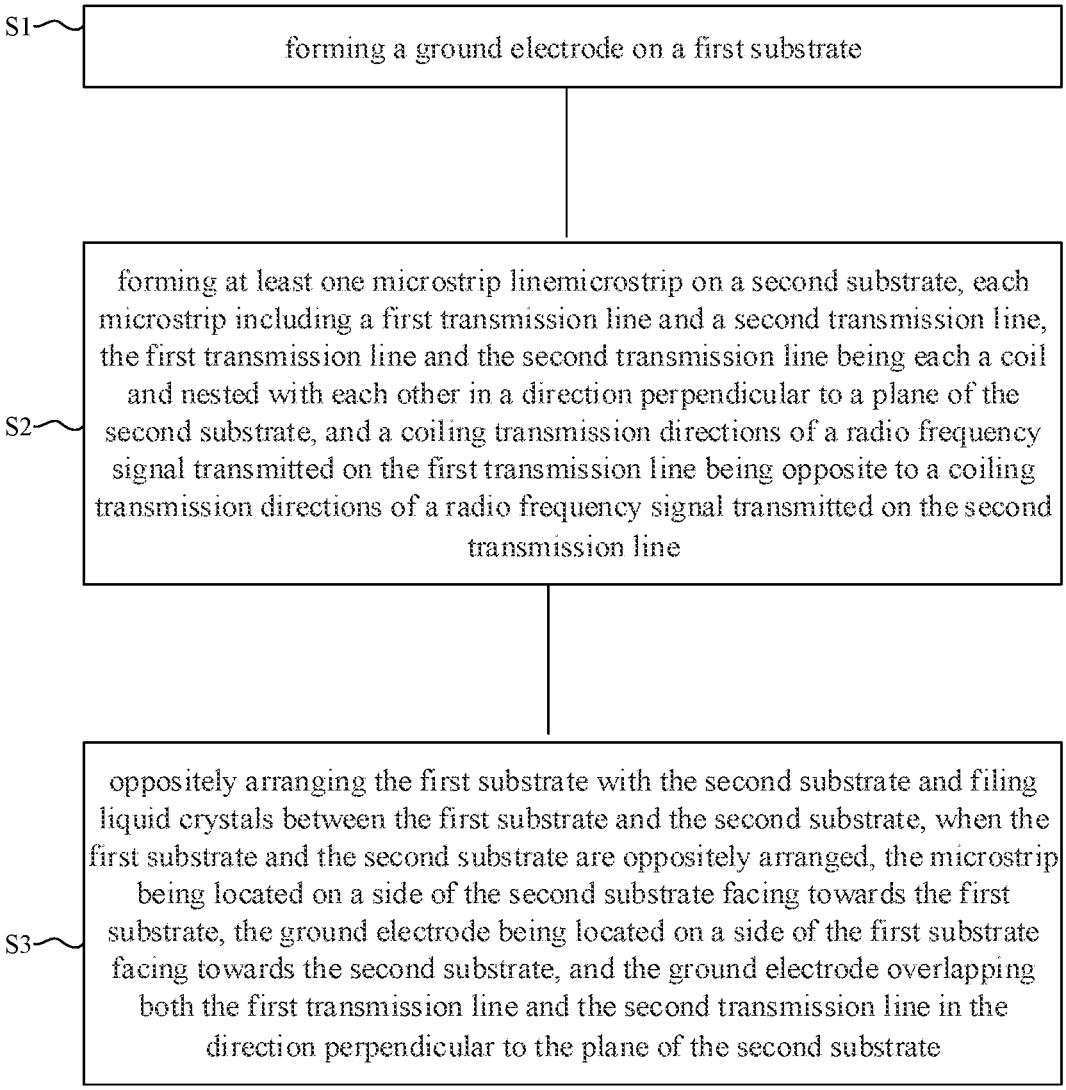
FIG. 14 is a flowchart of a manufacturing method provided by an embodiment of the present disclosure.
Figure 15:
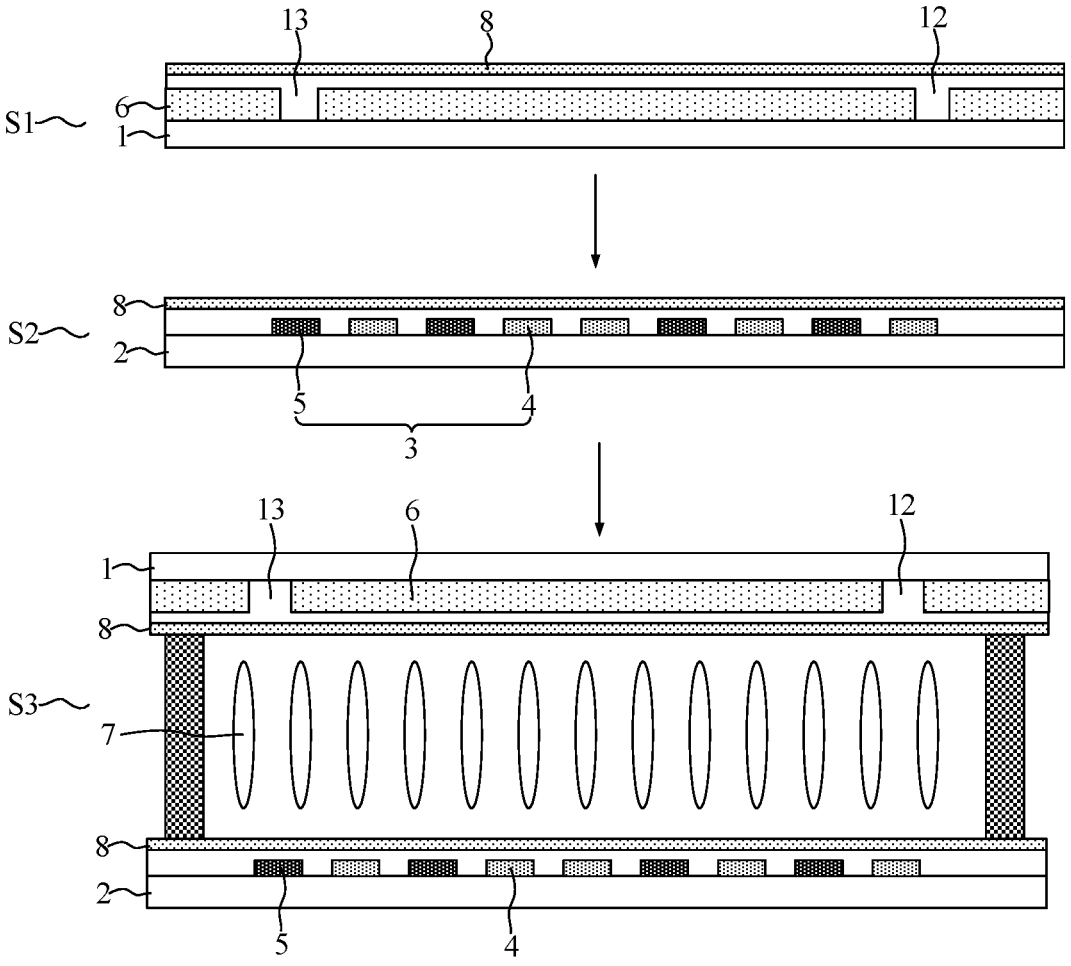
FIG. 15 is a flowchart of structures corresponding to FIG. 14.

Based on the same invention concept, the embodiments of the present disclosure further provide a manufacturing method of a liquid crystal phase shifter. FIG. 14 is a flowchart of a manufacturing method provided by an embodiment of the present disclosure, and FIG. 15 is a flowchart of structures corresponding to FIG. 14. As shown in FIGS. 14 and 15 in conjunction with FIGS. 2-4, the manufacturing method includes the following Steps S1 to S3.

In Step S1, a ground electrode 6 is formed on a first substrate 1.

In order to normally rotate the liquid crystals 7, the method further includes a step of forming an alignment film 8 on the ground electrode 6.

In Step S2, a microstrip 3 is formed on the second substrate 2. With reference to FIG. 3, the microstrip 3 includes a first transmission line 4 and a second transmission line 5 that both have a coil shape. The first transmission line 4 and the second transmission line 5 are nested with each other in the direction perpendicular to the plane of the second substrate 2, and a coiling transmission direction of the radio frequency signal in the first transmission line 4 is opposite to a coiling transmission direction of the radio frequency signal in the second transmission line 5.

In order to normally rotate the liquid crystals 7, an alignment film 8 is further formed on the microstrip 3.

In Step S3, the first substrate 1 is aligned with the second substrate 2 and the liquid crystals 7 are filled in such a manner that, after the first substrate 1 is aligned with the second substrate 2, the microstrip 3 is located a side of the second substrate 2 facing towards the first substrate 1, the ground electrode 6 is located on a side of the first substrate 1 facing towards the second substrate 2, and the ground electrode 6 overlaps both the first transmission line 4 and the second transmission line 5 in a direction perpendicular to the plane of the second substrate 2.

In the manufacturing method provided by the embodiment of the present disclosure, based on the coil shapes of the first transmission line 4 and the second transmission line 5 in the microstrip 3, on the one hand, each of the first transmission line 4 and the second transmission line 5 is equivalent to a coil structure. As a result, magnetic fields will be generated around the first transmission line 4 and the second transmission line 5 when radio frequency signals are transmitted on the first transmission line 4 and the second transmission line 5. Furthermore, since the coiling transmission direction of the radio frequency signal in the first transmission line 4 is opposite to the coiling transmission direction of the radio frequency signal in the second transmission line 5, the transmission directions of the high-frequency currents corresponding to the radio frequency signals are also opposite to each other. According to the right-hand screw rule, the magnetic field formed by the first transmission line 4 and the magnetic field formed by the second transmission line 5 have opposite directions. Therefore, the magnetic field formed by the first transmission line 4 offsets the magnetic field formed by the second transmission line 5, thereby effectively weakening the magnetic field of the entire microstrip 3 and reducing the inductive component of the characteristic impedance of the microstrip 3. In this way, the characteristic impedance of the microstrip 3 tends to be the pure resistance, which reduces the difficulties in impedance matching of the microstrip 3, thereby reducing return loss and optimizing the phase shifting effect of the liquid crystal phase shifter on the radio frequency signals. On the other hand, compared with the related art, by utilizing the shape of the microstrip 3 in the embodiments of the present disclosure, a wiring length of the microstrip 3 is increased while reducing the difficulties in impedance matching. In this way, the phase shift of the radio frequency signals transmitted on the microstrip 3 is more sufficient, further optimizing the phase shifting performance of the liquid crystal phase shifter.

In conjunction with FIG. 5 and FIG. 6, the step of forming the microstrip 3 on the second substrate 2 includes: forming the first transmission line 4 and the second transmission line 5 in the same layer on the second substrate 2. The first transmission line 4 includes a first input terminal Input1 and a first output terminal Output1. The first input terminal Input1 is an outermost end of the coil of the first transmission line 4, the first output terminal Output1 is an innermost end of the coil of the first transmission line 4, and the first input terminal Input1 is configured to receive the radio frequency signal. The second transmission line 5 includes a second input terminal Input2 and a second output terminal Output2. The second input terminal Input2 is an innermost end of the coil of the second transmission line 5, the second output terminal Output2 is an outermost end of the coil of the second transmission line 5, the second output terminal Output2 is configured to output the phase-shifted radio frequency signal, and the first output terminal Output1 is electrically connected to the second input terminal Input2.

With such a configuration, on the one hand, when radio frequency signals are transmitted on the first transmission line 4 and the second transmission line 5, the radio frequency signal transmitted on the first transmission line 4 is transmitted from the outer coil of the first transmission line 4 to the inner coil of the first transmission line 4, and the radio frequency signal transmitted on the second transmission line 5 is transmitted from the inner coil of the second transmission line 5 to the outer coil of the second transmission line 5. In this way, the coiling transmission directions of the radio frequency signals in the first transmission line 4 and the second transmission line 5 are opposite to each other, and then the magnetic field formed by the first transmission line 4 offsets the magnetic field formed by the second transmission line 5. On the other hand, the first output terminal Output1 is electrically connected to the second input terminal Input2, and the radio frequency signal transmitted on the first transmission line 4 is transmitted directly to the second input terminal Input2 through the first output terminal Output1, so that the radio frequency signal is transmitted from the first transmission line 4 to the second transmission line 5 with a higher transmission reliability and less loss of the radio frequency signal. Further, by arranging the first transmission line 4 and the second transmission line 5 in the same layer, the microstrip 3 only occupies one layer, which is more conducive to the thin and light-weight design of the liquid crystal phase shifter.

In another embodiment, in conjunction with FIGS. 5 and 10, the step of forming the microstrip 3 on the second substrate 2 includes: forming the first transmission line 4 and the second transmission line 5 in different layers on the second substrate 2, and forming an insulating layer 10 between the first transmission line 4 and the second transmission line 5, the insulating layer 10 having a via hole 11. The first transmission line 4 includes a first input terminal Input1 and a first output terminal Output1. The first input terminal Input1 is the outer end of the first transmission line 4 and is configured to receive the radio frequency signal. The second transmission line 5 includes a second input terminal Input2 and a second output terminal Output2. The second output terminal Output2 is an end the outermost loop of the coil of the second transmission line 5 and is configured to output the phase-shifted radio frequency signal, and the first output terminal Output1 is electrically connected to the second input terminal Input2 through the via hole 11.

With such a configuration, on the one hand, when radio frequency signals are transmitted on the first transmission line 4 and the second transmission line 5, the radio frequency signal transmitted to the first transmission line 4 is transmitted from the outermost loop of the coil of the first transmission line 4 to the innermost loop of the coil of the first transmission line 4, and the radio frequency signal transmitted on the second transmission line 5 is transmitted from the innermost loop of the coil of the second transmission line 5 to the outermost loop of the coil of the second transmission line 5. In this way, the coiling transmission directions of the radio frequency signals in the first transmission line 4 and the second transmission line 5 are opposite to each other, and thus the magnetic field formed by the first transmission line 4 offsets the magnetic field formed by the second transmission line 5. On the other hand, by directly electrically connecting the first transmission line 4 to the second transmission line 5, the radio frequency signal transmitted on the first transmission line 4 is transmitted directly to the second transmission line 5 with less loss of the radio frequency signal.

In an embodiment, in conjunction with FIGS. 5 and 11, the step of forming the microstrip 3 on the second substrate 2 includes: forming the first transmission line 4 and the second transmission line 5 in different layers on the second substrate 2, and forming an insulating layer 10 between the first transmission line 4 and the second transmission line 5. The first transmission line 4 includes a first input terminal Input1 and a first output terminal Output1. The first input terminal Input1 is an outermost end of the coil of the first transmission line 4, the first output terminal Output1 is an innermost end of the coil of the first transmission line 4, and the first input terminal Input1 is configured to receive the radio frequency signal. The second transmission line 5 includes a second input terminal Input2 and a second output terminal Output2. The second input terminal Input2 is an innermost end of the coil of the second transmission line 5, the second output terminal Output2 is an outermost end of the coil of the second transmission line 5. The second output terminal Output2 is configured to output the phase-shifted radio frequency signal, and the first output terminal Output1 overlaps the second input terminal Input2 in a direction perpendicular to the plane of the second substrate 2.

With such a configuration, on the one hand, when radio frequency signals are transmitted on the first transmission line 4 and the second transmission line 5, the radio frequency signal transmitted to the first transmission line 4 is transmitted from the outermost loop of the coil of the first transmission line 4 to the innermost loop of the coil of the first transmission line 4, and the radio frequency signal transmitted on the second transmission line 5 is transmitted from the outermost loop of the coil of the second transmission line 5 to the innermost loop of the coil of the second transmission line 5. In this way, the coiling transmission directions of the radio frequency signals in the first transmission line 4 and the second transmission line 5 are opposite to each other, and thus the magnetic field formed by the first transmission line 4 offsets the magnetic field formed by the second transmission line 5. On the other hand, it is unnecessary to build an electrical connection between the first transmission line 4 and the second transmission line 5, and the radio frequency signal transmitted on the first transmission line 4 is coupled to the second input terminal Input2 through the first output terminal Output1, such that the radio frequency signal is transmitted from the first transmission line 4 to the second transmission line 5. With such a manner of signal transmission, it is unnecessary to etch the via hole 11 in the insulating layer 10, which simplifies the processing and saves the process cost.

The embodiments of the present disclosure further provide a liquid crystal antenna. FIG. 16 is a structural schematic diagram of a liquid crystal antenna provided by an embodiment of the present disclosure, and FIG. 17 is a cross-sectional view taken along a direction C1-C2 in FIG. 16. As shown in FIG. 16 and FIG. 17, the liquid crystal antenna includes the above-mentioned liquid crystal phase shifter 100, a feed network 200, and a radiator 300. The feed network 200 is electrically connected to a radio frequency signal source 400 for providing radio frequency signals. The radiator 300 is located on a side of the first substrate 1 facing away from the second substrate 2 and is configured to radiate the phase-shifted radio frequency signal.

The liquid crystal antenna provided by the embodiments of the present disclosure includes the above-mentioned liquid crystal phase shifter 100, in which the microstrip 3 is a nested double-coil structure. Such a structure reduces the inductive impedance of the microstrip 3, and reduces the shape-related influence of the microstrip 3 on the impedance matching with less return loss, while further increasing the wiring length of the microstrip 3 and optimizing the phase shift effect of the radio frequency signal.

In an embodiment, referring to FIG. 17, the feed network 200 is located on the side of the first substrate 1 facing away from the second substrate 2, and the ground electrode 6 has a first opening 12 and a second opening 13 for coupling radio frequency signals. In the direction perpendicular to the plane of the second substrate 2, the first opening 12 overlaps both the feed network 200 and the first transmission line 4, and the second opening 13 overlaps both the second transmission line 5 and the radiator 300. In this case, the radio frequency signal provided by the feed network 200 is coupled to the first input terminal Input1 through the first opening 12, and is transmitted to the first transmission line 4 and the second transmission line 5. The phase-shifted radio frequency signal is coupled to the radiator 300 through the second opening 13, and is then radiated by the radiator 300.

Figure 18:
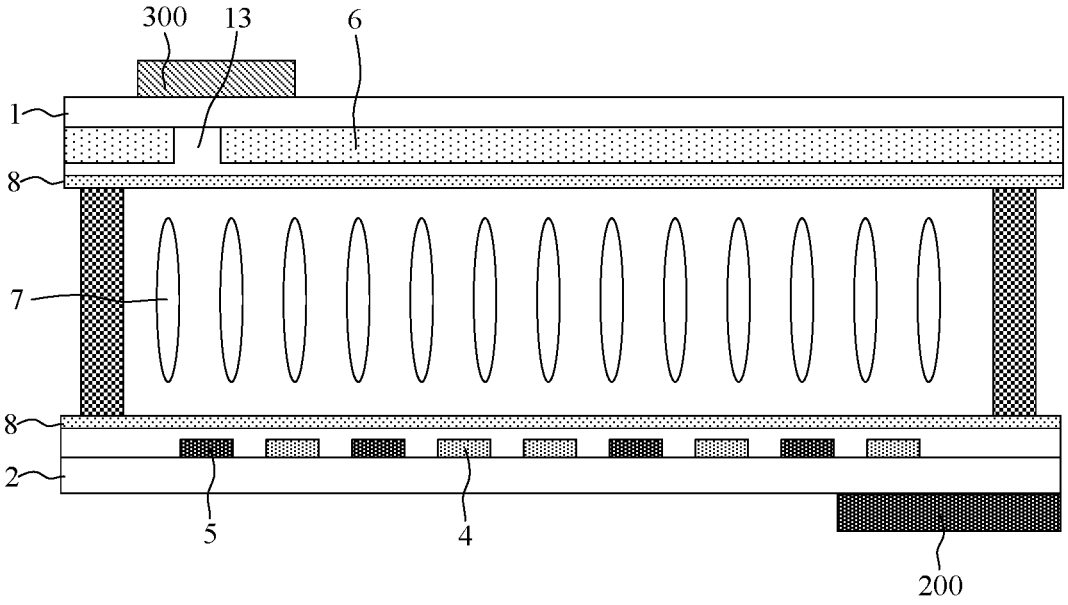
FIG. 18 is another cross-sectional view taken along the direction C1-C2 in FIG. 16.

FIG. 18 is another cross-sectional view taken along the direction C1-C2 in FIG. 16. As shown in FIG. 18, the feed network 200 is provided on the side of the second substrate 2 facing away from the first substrate 1, and the feed network 200 overlaps the first transmission line 4 in the direction perpendicular to the plane of the second substrate 2. The ground electrode 6 has a second opening 13 for coupling the radio frequency signal, and the second openings 13 overlaps both the second transmission line 5 and the radiator 300 in the direction perpendicular to the plane of the second substrate 2. Thus, the radio frequency signal provided by the feed network 200 is coupled to the first input terminal Input1 through the first opening 12 and is transmitted to the first transmission line 4 and the second transmission line 5, and the phase-shifted radio frequency signal is coupled to the radiator 300 through the second opening 13 and is radiated by the radiator 300.

In addition, the feed network 200 is arranged on the side of the second substrate 2 facing away from the first substrate 1, and the feed network 200 and the microstrip 3 are located on the same substrate. In this way, during the manufacturing process of the feed network 200, it is easy to align the feed network 200 with the microstrip 3, improving the alignment accuracy.

The above only illustrates some embodiments and does not limit the technical solutions of the present disclosure. Any modification, equivalent replacement, improvement, etc., made within the spirit and principle of this disclosure shall fall within the scope of disclosure.

What is claimed is:

1. A liquid crystal phase shifter, comprising:

a first substrate and a second substrate that are arranged opposite to each other, wherein the first substrate is located above a side of the second substrate that is facing a signal emission direction of the liquid crystal phase shifter;

at least one microstrip disposed on a side of the second substrate that is facing towards the first substrate, each microstrip comprising a first transmission line and a second transmission line, wherein the first transmission line and the second transmission line are each a coil and are nested with each other in a direction perpendicular to a plane of the second substrate, and wherein a coiling transmission direction of a radio frequency signal transmitted on the first transmission line is opposite to a coiling transmission direction of a radio frequency signal transmitted on the second transmission line;

a ground electrode disposed on a side of the first substrate that is facing towards the second substrate, wherein the ground electrode overlaps both the first transmission line and the second transmission line in the direction perpendicular to the plane of the second substrate; and liquid crystals located between the at least one microstrip and the ground electrode.

2. The liquid crystal phase shifter according to claim 1, wherein the first transmission line comprises a first input terminal and a first output terminal, the first input terminal is an outermost end of the coil of the first transmission line, the first output terminal is an innermost end of the coil of the first transmission line, and the first input end is configured to receive a radio frequency signal; and wherein the second transmission line comprises a second input terminal and a second output terminal, the second input terminal is an innermost end of the coil of the second transmission line, the second output terminal is an outermost end of the coil of the second transmission line, and the second output terminal is configured to radiate a phase-shifted radio frequency signal.

3. The liquid crystal phase shifter according to claim 2, wherein the first transmission line and the second transmission line are arranged in a same layer, and the first output terminal and the second input terminal are electrically connected to each other.

4. The liquid crystal phase shifter according to claim 3, wherein a number of coil turns of the first transmission line is equal to a number of coil turns of the second transmission line.

5. The liquid crystal phase shifter according to claim 4, wherein each of the at least one microstrip further comprises a third transmission line electrically connected to the second output terminal, and wherein the third transmission line has a coil shape.

6. The liquid crystal phase shifter according to claim 2, wherein the first transmission line and the second transmission line are arranged in different layers, an insulating layer is provided between the first transmission line and the second transmission line, the insulating layer comprises a via hole, and wherein the first output terminal and the second input terminal are electrically connected to each other through the via hole.

7. The liquid crystal phase shifter according to claim 2, wherein the first transmission line and the second transmission line are arranged in different layers, and an insulating layer is provided between the first transmission line and the second transmission line; and wherein the first output terminal overlaps the second input terminal in the direction perpendicular to the plane of the second substrate.

8. The liquid crystal phase shifter according to claim 7, wherein an orthographic projection of the first transmission line on the plane of the second substrate is spaced apart from an orthographic projection of the second transmission line on the plane of the second substrate by a distance greater than 50 μm.

9. The liquid crystal phase shifter according to claim 6, wherein a number of coil turns of the first transmission line is equal to a number of coil turns the second transmission line, and each of the at least one microstrip further comprises a third transmission line electrically connected to the second output terminal, and wherein the third transmission line has a coil shape.

10. The liquid crystal phase shifter according to claim 6, wherein a number of coil turns of the first transmission line is different from a number of coil turns the second transmission line.

11. The liquid crystal phase shifter according to claim 2, wherein the ground electrode comprises a first opening and a second opening configured to couple radio frequency signals, and wherein in the direction perpendicular to the plane of the second substrate, the first opening overlaps the first input terminal, and the second opening overlaps the second output terminal.

12. The liquid crystal phase shifter according to claim 1, wherein the first transmission line and the second transmission line are made of a same material.

13. The liquid crystal phase shifter according to claim 1, wherein a transmission line unit is formed by the first transmission line and the second transmission line that are nested with each other, and the at least one microstrip comprises m transmission line units, where $m \geq 2$, and wherein the second transmission line of an i-th transmission line unit of the m transmission line units is electrically connected to the first transmission line of a (i−1)-th transmission line unit of the m transmission line units, where $2 \leq i \leq m$.

14. A method for manufacturing a liquid crystal phase shifter, wherein the liquid crystal phase shifter comprises:

a first substrate and a second substrate that are arranged opposite to each other, wherein the first substrate is located above a side of the second substrate that is facing a signal emission direction of the liquid crystal phase shifter;

at least one microstrip disposed on a side of the second substrate that is facing towards the first substrate, each microstrip comprising a first transmission line and a second transmission line, wherein the first transmission line and the second transmission line are each a coil and are nested with each other in a direction perpendicular to a plane of the second substrate, and wherein a coiling transmission direction of a radio frequency signal transmitted on the first transmission line is opposite to a coiling transmission direction of a radio frequency signal transmitted on the second transmission line;

a ground electrode disposed on a side of the first substrate that is facing towards the second substrate, wherein the ground electrode overlaps both the first transmission line and the second transmission line in the direction perpendicular to the plane of the second substrate; and liquid crystals located between the at least one microstrip and the ground electrode, the method comprising:

forming the ground electrode on the first substrate;

forming the at least one microstrip on the second substrate, each of the at least one microstrip comprising the first transmission line and the second transmission line, wherein the first transmission line and the second transmission line are each a coil and are nested with each other in the direction perpendicular to the plane of the second substrate, and wherein the coiling transmission direction of the radio frequency signal transmitted on the first transmission line is opposite to the coiling transmission direction of the radio frequency signal transmitted on the second transmission line, and oppositely arranging the first substrate with the second substrate and filing liquid crystals between the first substrate and the second substrate, wherein, when the first substrate and the second substrate are oppositely arranged, the at least one microstrip is located on the side of the second substrate that is facing towards the first substrate, the ground electrode is located on the side of the first substrate that is facing towards the second substrate, and the ground electrode overlaps both the first transmission line and the second transmission line in the direction perpendicular to the plane of the second substrate.

15. The manufacturing method according to claim 14, wherein said forming the at least one microstrip on the second substrate comprises:

forming the first transmission line and the second transmission line in a same layer on the second substrate, wherein the first transmission line comprises a first input terminal and a first output terminal; the first input terminal is an outermost end of the coil of the first transmission line, the first output terminal is an innermost end of the coil of the first transmission line, and the first input terminal is configured to receive a radio frequency signal; the second transmission line comprises a second input terminal and a second output terminal, the second input terminal is an innermost end of the coil of the second transmission line, the second output terminal is an outermost end of the coil of the second transmission line, the second output terminal is configured to radiate a phase-shifted radio frequency signal; and the first output terminal is electrically connected to the second input terminal.

16. The manufacturing method according to claim 14, wherein said forming the at least one microstrip on the second substrate comprises:

forming the first transmission line and the second transmission line in different layers on the second substrate, wherein an insulating layer is provided between the first transmission line and the second transmission line, the insulating layer comprising a via hole, wherein the first transmission line comprises a first input terminal and a first output terminal; the first input terminal is an outermost end of the coil of the first transmission line and is configured to receive a radio frequency signal; the second transmission line comprises a second input terminal and a second output terminal, the second output terminal is an outermost end of the coil of the second transmission line and is configured to radiate a phase-shifted radio frequency signal; and the first output terminal is electrically connected to the second input terminal through the via hole.

17. The manufacturing method of claim 14, wherein said forming the at least one microstrip on the second substrate comprises:

forming the first transmission line and the second transmission line in different layers on the second substrate, wherein an insulating layer is provided between the first transmission line and the second transmission line, wherein the first transmission line comprises a first input terminal and a first output terminal, wherein the first input terminal is an outermost end of the coil of the first transmission line, wherein the first output terminal is an innermost end of the coil of the first transmission line, and the first input terminal is configured to receive a radio frequency signal;

wherein the second transmission line comprises a second input terminal and a second output terminal, and wherein the second input terminal is an innermost end of the coil of the second transmission line, the second output terminal is an outermost end of the coil of the second transmission line and is configured to radiate a phase-shifted radio frequency signal, and the first output terminal overlaps the second input terminal in the direction perpendicular to the plane of the second substrate.

18. A liquid crystal antenna, comprising:

a liquid crystal phase shifter;

a feed network configured to provide radio frequency signals; and a radiator arranged on a side of the first substrate facing away from the second substrate, and configured to radiate a phase-shifted radio frequency signal, wherein the liquid crystal phase shifter comprises;

a first substrate and a second substrate that are arranged opposite to each other, wherein the first substrate is located above a side of the second substrate that is facing a signal emission direction of the liquid crystal phase shifter;

at least one microstrip disposed on a side of the second substrate that is facing towards the first substrate, each microstrip comprising a first transmission line and a second transmission line, wherein the first transmission line and the second transmission line are each a coil and are nested with each other in a direction perpendicular to a plane of the second substrate, and wherein a coiling transmission direction of a radio frequency signal transmitted on the first transmission line is opposite to a coiling transmission direction of a radio frequency signal transmitted on the second transmission line;

a ground electrode disposed on a side of the first substrate that is facing towards the second substrate, wherein the ground electrode overlaps both the first transmission line and the second transmission line in the direction perpendicular to the plane of the second substrate; and liquid crystals located between the at least one microstrip and the ground electrode.

19. The liquid crystal antenna according to claim 18, wherein the feed network is arranged on the side of the first substrate facing away from the second substrate, and wherein the ground electrode comprises a first opening and a second opening are configured to couple the radio frequency signals, and wherein in the direction perpendicular to the plane of the second substrate, the first opening overlaps both the feed network and the first transmission line, and the second opening overlaps both the second transmission line and the radiator.

20. The liquid crystal antenna according to claim 18, wherein the feed network is provided on a side of the second substrate facing away from the first substrate, and the feed network overlaps the first transmission line in the direction perpendicular to the plane of the second substrate, and wherein the ground electrode comprises an opening configured to couple the radio frequency signals, and the second opening overlaps both the second transmission line and the radiator in the direction perpendicular to the plane of the second substrate.

* * * * *